US005722849A

United States Patent [19]

Alwine

[11] Patent Number: 5,722,849

[45] Date of Patent: Mar. 3, 1998

[54] CONNECTOR

[75] Inventor: K. Troy Alwine, Warren, Pa.

[73] Assignee: Osram Sylvania Inc., Danvers, Mass.

[21] Appl. No.: 719,669

[22] Filed: Sep. 25, 1996

[51] Int. Cl.[6] ..... H01R 13/627

[52] U.S. Cl. ..... 439/352

[58] Field of Search ..... 439/352, 353, 439/354, 357, 358, 372

[56] References Cited

U.S. PATENT DOCUMENTS 5,169,336 12/1992 Taguchi ..... 439/354

*Primary Examiner*—Khiem Nguyen
*Assistant Examiner*—Yong Ki Kim
*Attorney, Agent, or Firm*—William H. McNeill

[57] ABSTRACT

A connector is provided which includes first and second portions which are slidably engagable, and a lock disabler. The lock disabler includes a first enclosure-like segment pivotally attached to a second enclosure-like segment. When the first and second portions are fully engaged and the first segment has been attached to the second portion, the second segment may be pivoted relative to the first segment for attachment to the first portion to prevent disengagement of the first and second portions.

14 Claims, 4 Drawing Sheets

CONNECTOR

TECHNICAL FIELD

The present invention relates to first and second portions which are slidably engagable, and a lock disabler which can be pivoted from a first position allowing disengagement of engaged first and second portions to a second position preventing disengagement of engaged first and second portions. More particularly, the present invention relates an electrical connector which comprises such first and second portions and such lock disabler.

BACKGROUND ART

It is occasionally desirable to provide electrical connectors which may be mechanically and electrically connected together but not disconnected. For example, the ability to disconnect an electrical connector creates a potential safety hazard in high voltage applications. Such a concern exists in some electrical connections located under the hood of a motor vehicle. Some known devices rely upon the use of a connector position assurance (CPA) member such as described in U.S. Pat. No. 5,236,373. In structures of this type the CPA engages mating connector housings exterior thereof to lock such housings together. Such a CPA is not designed for use with connectors having internal latches which are not exposed to the outside of the connector. Other known devices involve the use of mating connector housings which are snap fit together, a lock disabler being provided to prevent unsnapping thereof. U.S. Pat. No. 5,370,550 is an example of such a device. A connector 10 of U.S. Pat. No. 5,370,550 is depicted in FIG. 1. Connector 10 comprises a first portion 12 and a second portion 14 which are slidably engagable. A lock 16 is distributed between portions 12 and 14 and comprises a locking tongue 18 which has a fixed end 20 on the first portion 12 and a free end 22 which extends from the fixed end 20. A keeper 24 is formed on the second portion 14 and the free end 22 is formed to engage the keeper. A lock disabler 26 is operatively positioned with the locking tongue 18 and is actuable, under normal conditions, only when the free end 22 of tongue 18 is engaged with the keeper 24. The lock disabler 26 has two operative positions with respect to the locking tongue 18 as described in U.S. Pat. No. 5,370,550, a first position allowing disengagement of the free end 22 of the locking tongue 18 from the keeper 24 and a second position preventing such disengagement. In use, after the portions 12 and 14 are connected together causing the locking tongue 18 to engage the keeper 24, the lock disabler 26 may be actuated to positively maintain the first portion 12 and second portion 14 in a mated condition, it then being virtually impossible to accidently separate such portions. However, in the invention described in U.S. Pat. No. 5,370,550 the latching components are not concealed, and it is possible to separate the first portion 12 and the second portion 14, if desired, even though the lock disabler 26 has been actuated.

DISCLOSURE OF THE INVENTION

It is, therefore, an object of the present invention to provide a connector which obviates the disadvantages of the prior art.

It is yet another object of the present invention to provide a connector having a lock disabler which can be actuated when the connector is fully engaged.

It is another object of the present invention to provide such a connector having a lock disabler which may be attached to one of the slidably engaging connector portions prior to when the connector is engaged or may be attached to both of the slidably engaging connector portions after they are fully engaged.

A further object of the present invention is to provide such a connector having a lock disabler and including locking members which are hidden from view and not exposed when in a mated state.

Another object of the present invention is to provide such a connector which is particularly useful in high voltage applications.

Yet another object of the present invention is to provide a connector having a latch disabler which may not be disconnected after being engaged.

This invention achieves these and other objects by providing a connector comprising a first slidably engaging portion comprising a first locking member, and a mating second slidably engaging portion comprising a second locking member. The first portion and the first locking member are disengaged from, in a first mode, and engaged with, in a second mode, the second portion and the second locking member, respectively. A lock disabler is provided which is attachable to the first portion and the second portion. The lock disabler comprises a first segment pivotally attached to a second segment, the second segment being pivotal relative to the first segment in the second mode from a first position allowing disengagement of the first locking member relative to the second locking member to a second position, preventing such disengagement.

BRIEF DESCRIPTION OF THE DRAWINGS

This invention may be clearly understood by reference to the attached drawings in which.

BEST MODE FOR CARRYING OUT THE INVENTION

Figure 1:
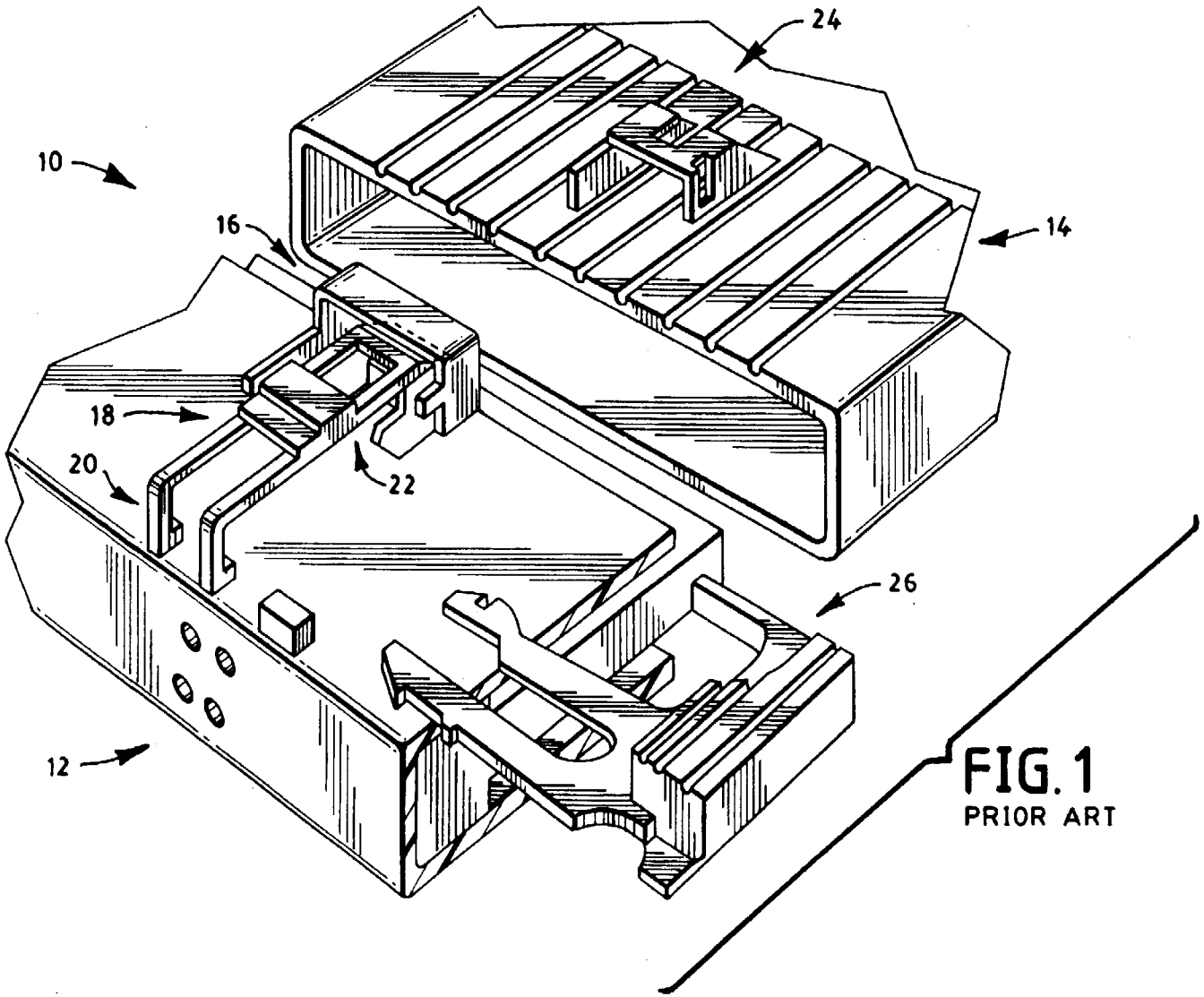
FIG. 1 PRIOR ART
FIG. 1 is an example of a prior art connector.
Figure 2:
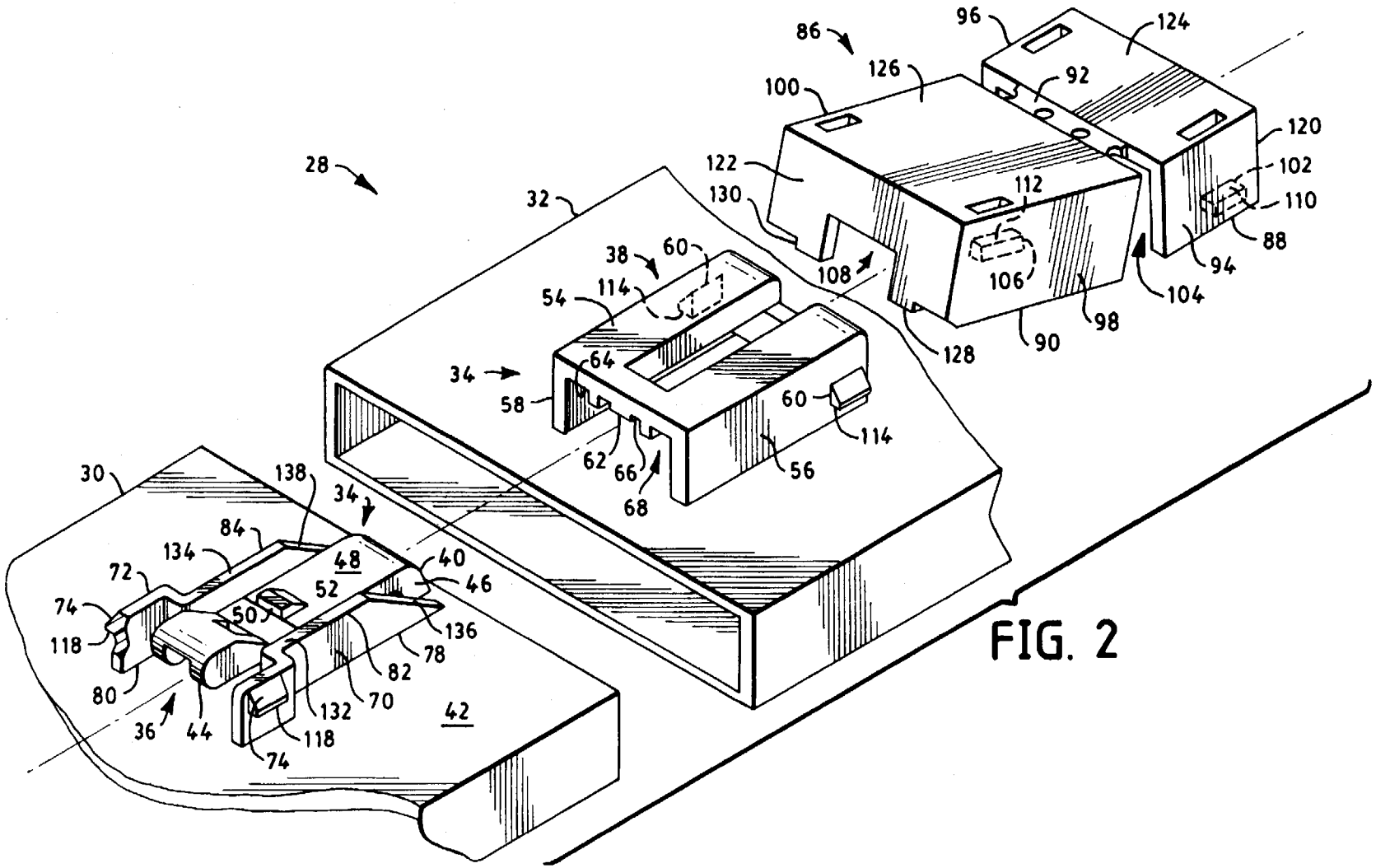
FIG. 2 is an exploded view partially sectioned of one embodiment of the present invention.

The embodiment of this invention which is illustrated in the drawings is particularly suited for achieving the objects of this invention. FIG. 2 depicts a connector 28 which comprises a first portion 30 and a second portion 32 which are slidably engagable in the conventional manner. A lock 34 is distributed between the portions 30 and 32. Lock 34 comprises a first locking member in the form of locking tongue 36 and second locking member in the form of a keeper 38. Locking tongue 36 comprises a fixed end 40 attached to the upper surface 42 of the portion 30 and a free end 44 extending from such fixed end. The fixed end 40 includes at least one upstanding leg 46 extending from upper surface 42. The free end 44 comprises a resilient cantilevered leg 48 which extends from leg 46. A lug 50 protrudes from the leg 48. In the embodiment of FIG. 2, lug 50 comprises an inclined surface 52.

The keeper 38 comprises a roof 54 which is supported by first and second spaced apart side walls 56 and 58 at least one of which comprises at least one keeper fastener. In the embodiment of FIG. 2, each side wall 56 and 58 includes a respective fastener 60.

Figure 3:
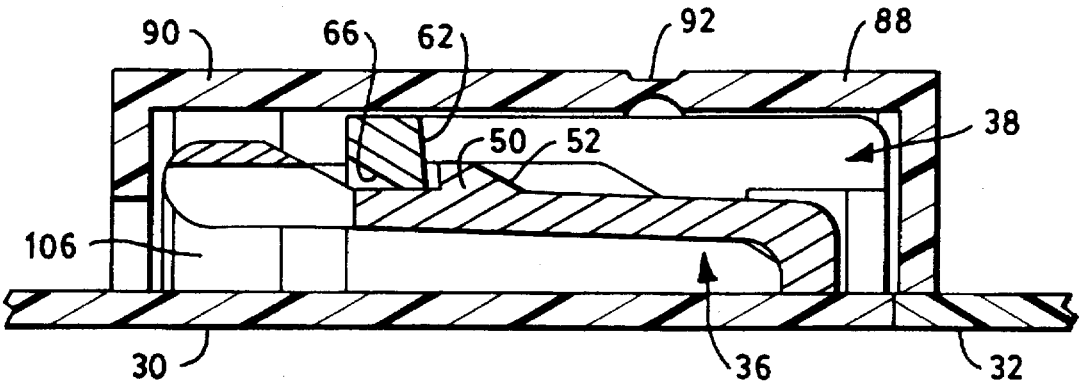
FIG. 3 is a diagrammatic representation in cross section of the embodiment of FIG. 2 in a fully engaged mode.

A depending lug 62 protrudes from an interior surface 64 of the roof 54, the lug 50 of free end 44 being configured to engage the lug 62. In particular, in considering the embodiment of FIGS. 2 and 3, the lug 62 comprises an inclined surface 66 which is adapted to engage the mating inclined surface 52 of lug 50 when the portions 30 and 32 are engaged in the conventional manner. The interrelationship between lugs 50 and 62 provides a camming action whereby as the locking tongue 36 slides into the opening 68 of the keeper 38, the surface 66 will engage surface 52 and depress the resilient leg 48 downward until the lug 50 snaps into place relative to the lug 62 as illustrated in FIG. 3. In this manner, the first portion 30 and second portion 32 may be locked together.

In the present invention, at least one side rail comprising at least one fastener is attached to the portion 30. For example, in the embodiment of FIG. 2 spaced apart first and second side rails 70 and 72 are provided, each of which comprises an identical respective fastener 74. Each side rail 70 and 72 has a respective end 78 and 80 attached to surface 42 of the portion 30 and a respective opposite end 82 and 84 extending away from surface 42. In the embodiment of FIG. 2, the locking tongue 36 is positioned between the first side rail 70 and the second side rail 72.

Figure 4:
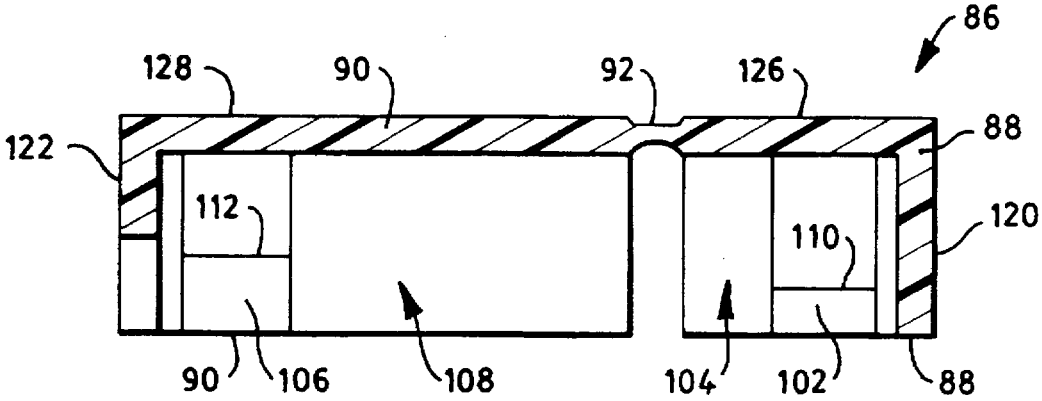
FIG. 4 is a cross section of the lock disabler of FIG. 2.
Figure 5:
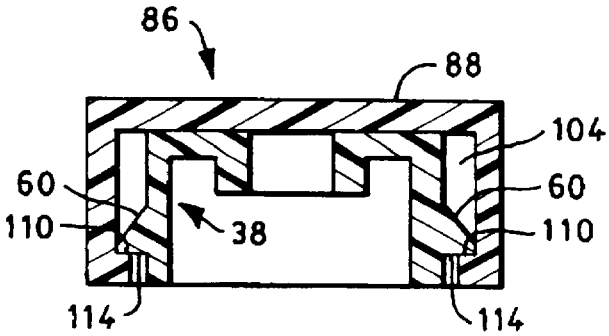
FIG. 5 is a transverse diagrammatic representation in cross section of the portion of the lock disabler of FIG. 3 attached to one embodiment of the keeper of the present invention.

In the embodiment of FIG. 2, a lock disabler is provided which includes a first segment pivotally attached to a second segment by a hinge. As explained in more detail hereinafter, the first segment and the second segment are attachable to the first portion 30 and second portion 32. For example, with reference to FIGS. 2 and 4, a lock disabler 86 is depicted comprising a first segment 88 pivotally attached to a second segment 90 by hinge 92. The first segment 88 is attachable to the first portion 30 at the keeper 38 so that when the first and second segments 30 and 32 are engaged causing the locking tongue 36 and the keeper 38 to be engaged, the second segment 90 may be pivoted about hinge 92 so as to be attached to the second portion 32 at the side rails 70 and 72. In this manner, the segments 88 and 90 enclose the locking tongue 36 and keeper 38 within the housing which such segments form. In other words, the lock disabler is pivotally movable when the first portion and first locking member are engaged with the second portion and second locking member from a first position allowing disengagement of the free end 44 from the keeper 38 to a second position preventing disengagement of such free end from such keeper. In order to attach the first segment 88 to the keeper 38, the first segment comprises at least one fastener which mates with a respective keeper fastener. Similarly, in order to attach the second segment 90 to the side rails 70, 72, the second segment 90 comprises at least one fastener which mates with a respective side rail fastener when the second segment is pivoted at hinge 92. For example, in the embodiment depicted in FIGS. 2 and 3, the lock disabler 86 is attached to the keeper 38 and to the side rails 70, 72 by keeper fasteners 60 and side rail fasteners 74, respectively, which engage respective mating fasteners located at respective inner surfaces of sides 94 and 96 of the first segment 88 and respective inner surfaces of sides 98 and 100 of second segment 90. Such mating fasteners may be in the form of protuberances 102 which extend from the inner surface of sides 94 and 96 into housing cavity 104 of the first segment 88, and protuberances 106 which extend from inner surfaces of sides 98 and 100 into housing cavity 108 of the second segment 90. For example, protuberances 102 extend into cavity 104 and comprise respective upper surfaces 110 and protuberances 106 extend into cavity 108 and comprise respective upper surfaces 112. When the first segment 88 is attached to the keeper 38, each upper surface 110 of protuberances 102 will engage a respective lower surface 114 of the keeper fasteners 60. In a similar manner, each upper surface 112 of protuberances 106 will engage a respective lower surface 118 of respective side rail fasteners 74 when the second segment 90 is pivoted about hinge 92 towards the side rails 70, 72.

It will be apparent to those skilled in the art that the first segment 88 of the lock disabler 86 may be attached to the keeper 38 in a first mode before the first portion 30 is engaged with the second portion 32, and then the second segment 90 may be pivoted at hinge 92 and attached to the side rails 70, 72 in a second mode after the first and second portions are engaged. Such an embodiment is depicted in FIG. 2. Alternatively, if desired the first segment 88 and the second segment 90 may be attached to the keeper 38 and the side rails 70, 72, respectively, after the first and second portions 30, 32 have been engaged. It will also be readily apparent to those skilled in the art that the fasteners 60 and 74 may be attached directly to the second portion 32 and first portion 30, respectively, rather than being provided as protuberances of the keeper and side rails as depicted in the drawings. In such embodiment, the side rails may be eliminated, if desired.

In the embodiment depicted in the drawings, the lock disabler 86 is in the form of a box-like enclosure formed by the first segment 88 and the second segment 90. Such box-like enclosure includes the sides 94, 96, 98, 100, further sides 120, 122 and top portions 124, 126. When the fasteners of the first and second segments 88 and 90 are attached to respective fasteners of the keeper 38 and side rails 70, 72 as described herein, such box-like enclosure will enclose the lock 34 provided by locking tongue 36 and keeper 38 as depicted in FIG. 3, thereby preventing access to such lock.

Figure 6:
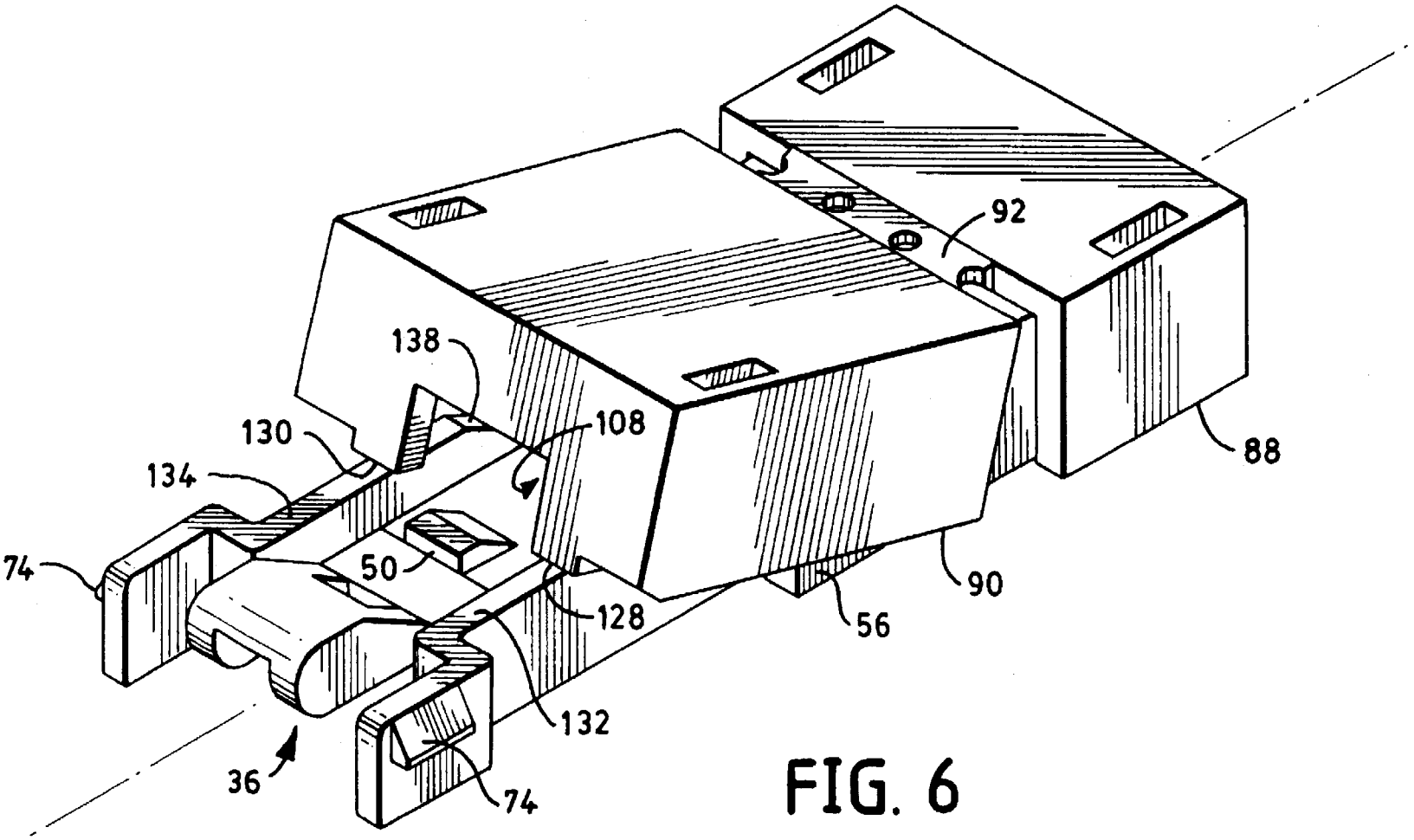
FIG. 6 is a perspective view of the embodiment of FIG. 2 partially assembled.

In the embodiment illustrated in the drawings, the keeper 38 comprises first and second legs 128 and 130 which are alignable with respective rails 70 and 72. Legs 128 and 130 serve to facilitate engagement of the first portion 30 and the second portion 32 when the first segment 88 of the lock disabler 86 is attached to the second portion 32 in the first mode; that is prior to when the first portion 30 and locking tongue 36 are engaged with the second portion 32 and keeper 38. In particular, when the first portion 30 is slid into engagement with the second portion 32 from the first mode to the second mode, the first and second legs 128 and 130 will engage and slide relative to the top surfaces 132 and 134 of the rails 70 and 72, respectively as depicted in FIG. 6. In the preferred embodiment, the top surfaces 132 and 134 will comprise an inclined length 136 and 138 to facilitate such sliding of the legs 128 and 130 relative thereto.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

What is claimed is:

1. A connector comprising:

a first slidably engaging portion comprising a first locking member;

a mating second slidably engaging portion comprising a second locking member, said first portion and said first locking member being disengaged from, in a first mode, and being engaged with, in a second mode, said second portion and said second locking member, respectively;

a lock disabler attachable to said first portion and said second portion and comprising a first segment pivotally attached to a second segment, said second segment being pivotal relative to said first segment in said second mode from a first position allowing disengagement of said first locking member relative to said second locking member to a second position preventing said disengagement, said first segment comprising at least one first lock disabler fastener and said second segment comprising at least one second lock disabler fastener, and further wherein said first portion comprises at least one first portion fastener which mates with said at least one second lock disabler fastener and said second portion comprises at least one second portion fastener which mates with said at least one first lock disabler fastener.

2. The connector of claim 1 wherein said first locking member comprises a locking tongue and said second locking member comprises a keeper.

3. The connector of claim 1 wherein said first locking member comprises a locking tongue and said second locking member comprises a keeper.

4. The connector of claim 3 further comprising spaced apart first and second side rails, each side rail comprising a first portion fastener which mates with a respective second lock disabler fastener, said locking tongue being positioned between said first and second side rails, and further wherein said second locking member comprises a keeper, said keeper comprising at least two second portion fasteners which mate with respective first lock disabler fasteners.

5. A connector comprising:

a first slidably engaging portion comprising a first locking member;

a mating second slidably engaging portion comprising a second locking member, said first portion and said first locking member being disengaged from, in a first mode, and being engaged with, in a second mode, said second portion and said second locking member, respectively; and a lock disabler attachable to said first portion and said second portion and comprising a first segment pivotally attached to a second segment, said second segment being pivotal relative to said first segment in said second mode from a first position allowing disengagement of said first locking member relative to said second locking member to a second position preventing said disengagement, said first segment being attached to said second portion in said first mode.

6. The connector of claim 5 wherein said first locking member comprises a locking tongue and said second locking member comprises a keeper.

7. The connector of claim 6 further comprising spaced apart first and second side rails, each side rail comprising a first portion fastener which mates with a respective second lock disabler fastener, said locking tongue being positioned between said first and second side rails, and further wherein said second locking member comprises a keeper, said keeper comprising at least two second portion fasteners which mate with respective first lock disabler fasteners.

8. The connector of claim 5 wherein said first segment comprises at least one first lock disabler fastener and said second segment comprises at least one second lock disabler fastener, and further wherein said first portion comprises at least one first portion fastener which mates with said at least one second lock disabler fastener and said second portion comprises at least one second portion fastener which mates with said at least one first lock disabler fastener.

9. The connector of claim 7 wherein said second segment comprises first and second legs which are alignable with said first and second side rails, respectively.

10. The connector of claim 9 wherein said first and second side rails each comprise an inclined length alignable with said first and second legs, respectively.

11. A connector comprising:

a first slidably engaging portion and a second slidably engaging portion;

a lock distributed between said first slidably engaging portion and said second slidably engaging portion, said lock comprising (a) a locking tongue having a fixed end attached to said first slidably engaging portion, and a free end extending therefrom and comprising a protruding lug, and (b) a keeper on said second portion, said keeper having a roof and first and second spaced apart side walls, and a depending lug on an interior of said roof, said protruding lug being formed for engagement with said depending lug;

a lock disabler comprising a first segment pivotally attached to a second segment, said first segment being attachable to said second portion and said second segment being attachable to said first portion, said second segment being pivotal relative to said first segment, when said protruding lug and said depending lug are engaged, from a first position allowing disengagement of said protruding lug from said depending lug to a second position preventing said disengagement, said first segment comprising at least one first lock disabler fastener and said second segment comprising at least one second lock disabler fastener, and further wherein said first portion comprises at least one first portion fastener which mates with said at least one second lock disabler fastener and said second portion comprises at least one second portion fastener which mates with said at least one first lock disabler fastener.

12. The connector of claim 11 further comprising spaced apart first and second side rails, each side rail comprising a first portion fastener which mates with a respective second lock disabler fastener, said locking tongue being positioned between said first and second side rails, and further wherein said second locking member comprises a keeper, said keeper comprising at least two second portion fasteners which mate with respective first lock disabler fasteners.

13. The connector of claim 12 wherein said second segment comprises first and second legs which are alignable with said first and second side rails, respectively.

14. The connector of claim 13 wherein said first and second side rails each comprise an inclined length alignable with said first and second legs, respectively.

* * * * *